United States Patent [19]

Jong

[11] Patent Number: 4,779,393

[45] Date of Patent: Oct. 25, 1988

[54] BUILDING METHODS AND STRUCTURES

[76] Inventor: Slosson B. Jong, 20722 Hunter La., Huntington Beach, Calif. 92646

[21] Appl. No.: 69,885

[22] Filed: Jul. 6, 1987

[51] Int. Cl.[4] ..... E04C 1/10

[52] U.S. Cl. ..... 52/585; 52/747; 411/388

[58] Field of Search ..... 52/585, 715; 411/388, 411/397, 389, 384, 460

[56] References Cited

U.S. PATENT DOCUMENTS

| | | | |
|---|---|---|---|
| 346,148 | 7/1886 | Durham | 411/388 |
| 1,777,926 | 10/1930 | Lillard | 52/585 |
| 1,954,954 | 4/1934 | Shugart | 52/585 |
| 2,230,392 | 2/1941 | Storms | 411/460 |
| 3,390,497 | 7/1968 | Longinotti | 52/585 |
| 3,922,832 | 12/1975 | Dicker | 52/585 |
| 3,960,460 | 6/1976 | Fischer | 52/585 |
| 4,052,831 | 10/1977 | Roberts | 52/715 |
| 4,488,389 | 12/1984 | Furmont | 52/DIG. 6 |
| 4,571,911 | 2/1986 | Dunlap | 52/715 |

FOREIGN PATENT DOCUMENTS

| | | | |
|---|---|---|---|
| 1366095 | 6/1964 | France | 411/388 |
| 518927 | 3/1955 | Italy | 411/389 |
| 654181 | 6/1951 | United Kingdom | 411/388 |

*Primary Examiner*—Henry E. Raduazo
*Attorney, Agent, or Firm*—William P. Green

[57] ABSTRACT

A wall or other integrated structure is formed from a series of blocks or other building units utilizing double ended fasteners having two ends facing in opposite directions which are driven into opposed faces of adjacent blocks to retain them against relative displacement. The fasteners may also furnction to attach connector straps or members to the blocks, with those straps or members extending between different blocks to secure them in place. The individual fasteners may have two pointed nail type ends projecting in opposite directions, or may have one threaded end and one unthreaded end. In some instances, one of the ends of the fastener may be detachable from the other, to be connectible thereto after that other end has been screwed or otherwise driven into one of the blocks.

8 Claims, 2 Drawing Sheets

FIG. 1
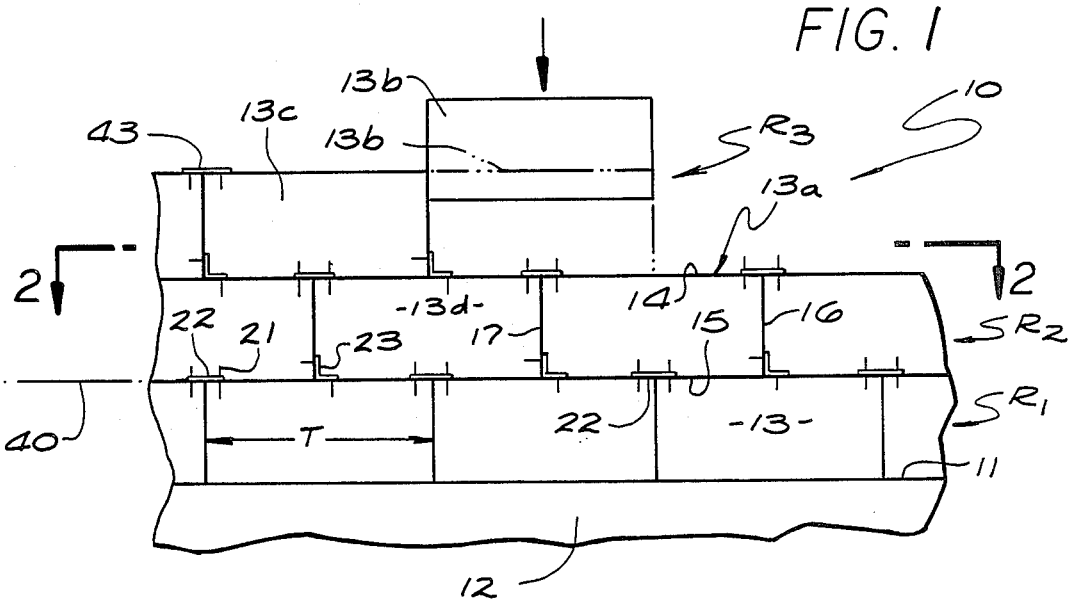
FIG. 2
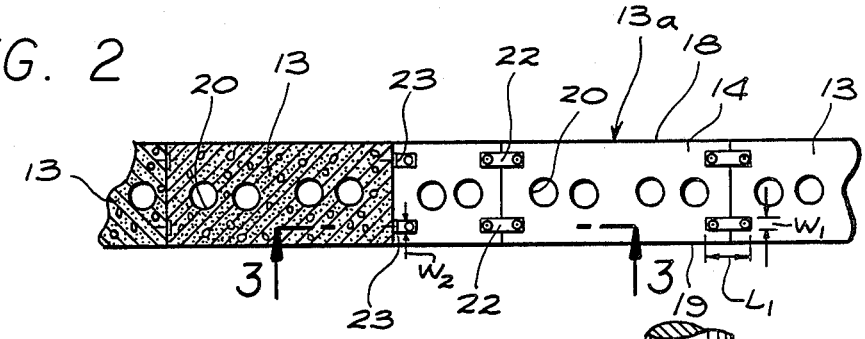
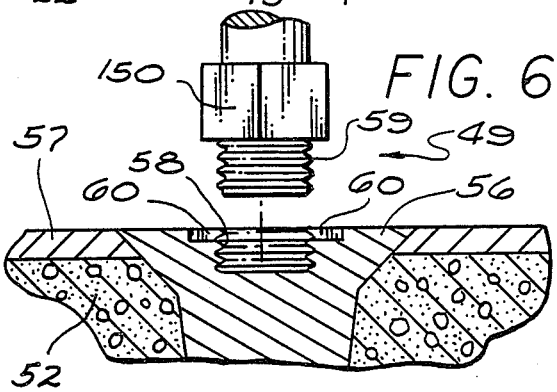
FIG. 6
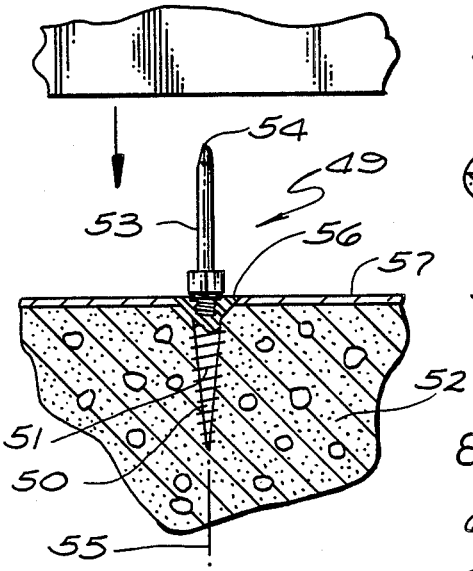
FIG. 5
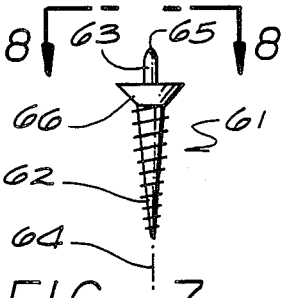
FIG. 7
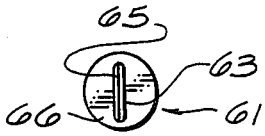
FIG. 8

BUILDING METHODS AND STRUCTURES

This invention relates to the construction of walls or other similar integrated structures from a series of building units such as blocks.

BACKGROUND OF THE INVENTION

In building a block wall, various means have been provided for attaching the different individual blocks together and preventing their relative displacement under any forces which may be encountered in use, such as earthquake forces. In some instances, the blocks, which term is defined as including bricks as well as cement blocks or the like, are retained against relative displacement only by the provision of mortar between successive rows of blocks and between individual blocks in a particular row. In other cases, reinforcing rods or other reinforcing elements have been inserted into or between different blocks, or a mass of reinforced or unreinforced concrete has been filled into openings in the blocks or between two spaced walls. In other cases, the blocks have been specially molded of relatively intricate shapes adapted to interfit with one another during assembly in a manner intended to hold adjacent blocks in fixed relative. positions. All of these prior methods involve more expenditure than would be desired in labor and/or materials.

SUMMARY OF THE INVENTION

The present invention is directed to the provision of improved arrangements for securing the different individual blocks or other building units of a wall or other composite integrated structure very positively and effectively in fixed relative positions in a manner maintaining the integrity of the overall structure under adverse conditions and forces, and doing so in a much less expensive manner than any of the methods utilized in conventional construction procedures. In certain respects, the building methods of the present invention are especially useful in forming a wall from blocks formed of the cementitious composition disclosed and claimed in my U.S. Pat. No. 4,655,837 issued Apr. 7, 1987 on "Building Material And Manufacture Thereof". The material of that patent is much lighter in weight than conventional cement blocks, is porous, can be worked into different shapes by sawing or the like, and can receive and hold nails, screws, and other fasteners penetrating into the material of the blocks.

A major feature of the present invention resides in a unique method of interconnecting adjacent blocks or other building units in a wall or the like by double ended fasteners extending between and driven into opposed faces of adjacent blocks. The two ends of each fastener project in opposite directions, and each forms in effect a nail or threaded screw which can be driven into a corresponding one of the blocks to penetrate a substantial distance into the material of that block and form an effective connection thereto. Preferably, one of the ends of the fastener is driven into a first of the blocks before the adjacent second block has been moved into position, after which the second block is forced or driven toward the first block and against the projecting second end of the fastener to effect penetration of that second end into the material of the second block and thus complete the connection between the two blocks. In some instances, the second end of the fastener may be formed separately from the first end and be left unattached to the first end while the first end is driven into its corresponding block, with the second end then being threadedly or otherwise attached to the first end to project therefrom and enable its connection to the second block by movement thereof as described.

Additional features of the invention relate to the provision, in conjunction with the double ended fasteners, of connector members which function to attach two blocks together, and which may be connected to one of the blocks by one of the discussed double ended fasteners. One of the two oppositely directed ends of a fastener may be passed through an opening in such a connector member before being driven into one of the blocks, to in this way attach the connector member to that block. The connector member may take the form of a strap extending between two adjacent blocks typically in the same row of blocks in a wall structure, or may be an angle bracket having a first arm connected to a block in one row, and a second arm connected to a block in a next upper or next lower row.

BRIEF DESCRIPTION OF THE DRAWINGS

The above and other features and objects of the invention will be better understood from the following detailed description of the typical embodiments illustrated in the accompanying drawings in which:

FIG. 1 is a fragmentary side elevational representation of a block wall formed in accordance with the invention;

FIG. 2 is a partially sectional and partially plan elevational view taken on line 2—2 of FIG. 1;

FIG. 5 is a view corresponding to a portion of FIG. 3, but showing a different type of fastener having one threaded end and one unthreaded end;

FIG. 6 is an enlargement of a portion of FIG. 5, showing the threaded and unthreaded ends of the fastener separated;

FIG. 7 is a view similar to FIG. 5, but showing another variational type of fastener; and FIG. 8 is a plan view of the FIG. 7 fastener taken on line 8—8 of FIG. 7.

DESCRIPTION OF THE PREFERRED EMBODIMENTS

Figure 3:
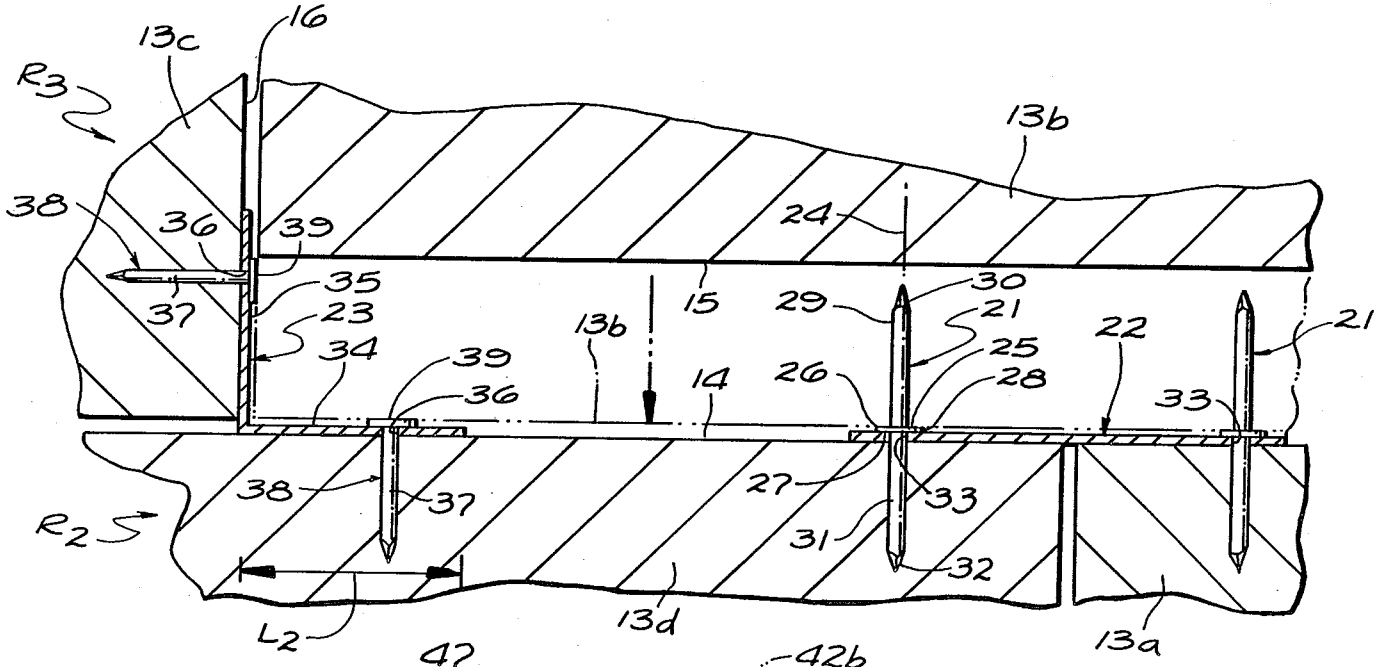
FIG. 3 is an enlarged fragmentary vertical section taken on lines 3—3 of FIG. 2.

There is illustrated in FIG. 1 a partially completed vertically extending wall 10 formed in accordance with the invention and typically illustrated as supported on and projecting upwardly from the horizontal upper surface 11 of a base 12. This base may be any suitable support structure, such as a foundation formed of concrete or other material, the floor of a building, the surface of the earth, or the like. Wall 10 is made of a number of preferably identical and preferably rectangular blocks 13 formed of a rigid material having sufficient strength to give the completed wall the structural integrity required to withstand whatever forces may be encountered in use. One material of which the blocks 13 may be formed is the cementitious material disclosed in my U.S. Pat. No. 4,655,837 issued Apr. 7, 1987. The blocks are arranged in conventional manner in a series of vertically successive rows $R_1$, $R_2$, $R_3$, etc.

With particular reference as an example to the block which is identified as block 13*a* in FIGS. 1 and 2, each of the blocks is defined by two parallel horizontal top and bottom surfaces 14 and 15, two parallel vertical rectangular opposite end surfaces 16 and 17, and two parallel vertical rectangular opposite side surfaces 18 and 19 perpendicular to surfaces 14, 15, 16 and 17. Each block may contain one or more vertically extending typically cylindrical passages 20 which may if necessary receive reinforcing rods and/or concrete filled into these passages after the wall has been completed or partially completed. The passages 20 of the different blocks are so located that the passages within the blocks in the different rows $R_1$, $R_2$, $R_3$, etc. communicate vertically with one another to enable reinforcing rods and/or concrete to be inserted downwardly from the top of the wall through all of the rows of blocks. In many instances, however, the strength of the blocks and the later-to-be-described connections between the blocks will give the composite integrated wall structure sufficient strength to serve its intended purpose without the necessity for reinforcing rods or concrete filled into passages 20.

In the first form of the invention illustrated in FIGS. 1 to 3, the blocks 13 of the wall are secured together and against relative displacement by an arrangement of attaching fasteners and connecting members or brackets including a series of double ended fasteners 21, a number of connector members 22 attaching successive blocks in a particular row together, and a series of connector members 23 securing blocks in one row to those of the next higher row. As seen best in FIG. 3, each of the double ended fasteners 21 in this first form of the invention can be considered in effect as a double ended nail which in the assembled wall structure extends along a vertical axis 24 and is driven into two vertically adjacent blocks 13. At the center of the vertical extent of each such fastener, it has an enlarged head or flange 25 disposed transversely of axis 24 and having upper and lower annular planar surfaces 26 and 27 perpendicular to that axis. The peripheral edge 28 of head 25 is preferably circular about axis 24. Projecting upwardly from head 25, the double ended nail 21 has a first end portion or shank 29 forming in effect an upwardly projecting nail which may be externally cylindrical about axis 24 and terminate at an upper tapered and preferably sharply pointed extremity 30. A second end or shank of the fastener 21 projects downwardly from head 25 at 31, and may be identical with the upper end 29 but inverted with respect thereto, being externally cylindrical and of the same diameter and length as upper end 29 and terminating at a conically tapered preferably sharply pointed lower extremity 32.

Each of the connector members 22 may take the form of a flat connector strap or bracket which in the completed wall extends horizontally in engagement with the upper surfaces 14 of two adjacent blocks in a particular row, and which has sufficient strength to form a firm and permanent connection between those blocks. These connector straps 22 may for example be formed of an appropriate sheet metal, such as galvanized sheet steel. As seen in FIG. 2, each connector 22 has a length dimension $L_1$ greater than its width dimension $W_1$, and may be generally rectangular as shown. Near its opposite ends, each strap 22 contains two typically circular openings 33 which receive and are of a diameter corresponding substantially to the lower nail end portions 31 of two of the double ended nails 21, as seen in FIG. 3.

The second type of connector 23 of the FIGS. 1 to 3 form of the invention is shaped generally as an angle bracket, having an arm 34 which is planar and extends horizontally in the FIG. 3 position of the bracket, and having a second arm 35 which is planar but projects vertically and perpendicular to arm 34. Bracket 23 may be formed of the same type of material as connector strap 22, that is, of a material having sufficient strength and rigidity to maintain its shape and retain the connected blocks in fixed positions in the assembled wall. More specifically, bracket 23 may be formed of sheet metal, such as galvanized sheet steel. Each bracket 23 may have a width dimension $W_2$ corresponding essentially to the width dimension $W_1$ of connector straps 22, and each of the arms 34 and 35 may have a length dimension $L_2$ greater than the width dimension $W_2$. The arms 34 and 35 of bracket 23 contain near their ends typically circular openings 36 which may be of the same size as openings 33 in straps 22, and which are dimensioned to closely receive the cylindrical pointed shanks 37 of nails 38 having enlarged heads 39.

To now describe the method of assembly of the wall 10 of FIGS. 1 to 3, assume that the blocks of bottom row $R_1$ of FIG. 1 have been positioned on the base or foundation structure 12 as shown, in alignment with one another along a longitudinal horizontal axis 40, and have been appropriately secured to the base structure in fixed positions relative thereto. At their upper sides, these blocks are secured to one another by a series of the connector straps 22, each of which extends between one block and the next successive block in the same row and is in engagement with the upper surfaces 14 of those two blocks. Each connector 22 is retained in this connecting position and secured to the engaged blocks by driving the lower nail ends 31 of two of the double ended fasteners 21 downwardly through openings 33 formed in the opposite end portions of the connector strap 22 and into the material of the two blocks, as represented in FIG. 3. This driving action may be effected by any tool capable of exerting downward force on head 25 of the double ended nail 21 without damaging the upwardly projecting end 29 of the fastener. The driving action is continued until head 25 of each of the two double ended nails engages connector strap 22 and holds it tightly downwardly against the upper surface 14 of the corresponding block, to thus form a rigid connection between each of the double ended nails 21 and the block into which it is driven, and also form a rigid connection between connector strap 22 and both the nail and block. After both of the double ended nails have in this way been driven through the opposite end portions of connector strap 22 and into the two adjacent blocks in a particular row of blocks, the resulting connection acts to very effectively hold those two blocks in set positions. As seen in FIG. 2, two such connector straps may be nailed in this way to each pair of blocks, at spaced locations near the opposite side faces 18 and 19 respectively of the blocks, with the upper ends 29 of the four double ended nails 21 attached to these straps projecting upwardly in parallel relation.

After all of the blocks in the bottom row $R_1$ have been connected by straps 22 and double ended nails 21 as described, the blocks of the second row $R_2$ are successively moved into position and retained by the double ended fasteners and brackets 23. Additional straps 22 are then connected to the upper sides of the blocks of row $R_2$, in preparation for the next upper row $R_3$.

The manner by which each block is held in place will be best understood by reference to FIG. 3, which illustrates the process of connecting a particular block **13*b* in row $R_3$ adjacent a next successive block 13*c* of the same row and to the previously mentioned block 13***a* of row $R_2$ and a next successive block 13*d* of row $R_2$. In FIGS. 1, 2 and 3, it is seen that the two blocks 13*a* and 13*d* of row $R_2$ have been connected together by two of the straps 22 and four double ended nails 21, with the lower ends of those nails projecting downwardly through straps 22 and into blocks 13*a* and 13*d*, and with the upper ends of the nails projecting upwardly in parallel relation. Also, two of the angle brackets 23 have been secured to the upper side of block 13*d*, by driving nails 38 downwardly through their arms 34 and into block 13*d* with arms 35 of the brackets being received adjacent and in engagement with the end surface 16 of block 13*c* and being secured thereto by two nails 38 driven horizontally through arms 35 and into the block. As will be apparent, the end surface 16 and vertical arms 35 of brackets 23 are located at the center of the horizontal length dimension T of block 13*d*, and the other brackets 23 are of course similarly located at the centers of the other blocks to which they are attached.

With blocks 13*a*, 13*c* and 13*d* in place, and with connector members 22 and 23 nailed to those blocks as discussed, the block 13*b* is brought into the position illustrated in FIGS. 1 and 3 closely adjacent end surface 16 of block 13*c* and directly above the upwardly projecting upper ends of double ended nails 21, following which the block 13*b* is forced downwardly against and relative to the upwardly projecting ends of the double ended nails 21, so that by the downward movement of block 13*b* the upwardly projecting ends of the four nails 21 are driven into the underside of that block at spaced locations, and are forced to penetrate the material of that block to form a rigid connection thereto. The block may be driven or forced downwardly in any convenient manner, as by hammer blows or other mechanical forces applied to the upper surface of block 13*b*, with the block being held during the application of such force in a position in which the undersurface 15 of the block is continuously horizontal and directly parallel to the upper surfaces 14 of blocks 13*a* and 13*d*. The end surface 17 of block 13*b* is similarly maintained continuously vertical and parallel to and closely proximate end surface 16 of block 13*c*, leaving only room for arm 35 of bracket 23 and the heads of the attaching nails 38. Also, the opposite side surfaces 18 and 19 of block 13*b* are of course maintained in alignment with the planes of the corresponding vertical side surfaces 18 and 19 of the other blocks 13*a* , 13*c*, 13*d*, etc., to assure proper positioning of block 13*b* with respect to the other blocks of the overall wall structure. If desired, grout, mastic or another substance may be inserted between the underside of block 13*b* and the upper surfaces of blocks 13*a* and 13*d*, and similarly may be inserted between blocks 13*b* and 13*c*, as well as between all of the other adjacent blocks of the wall. However, it is contemplated that the present wall structure may if desired be utilized without the necessity for such grout or mastic.

After block 13*b* has been driven into position (broken lines in FIGS. 1 and 3), another bracket 23 is moved into position at the right end of block 13*b* and nailed to that block and to block 13*a*, so that the next block in row $R_3$ can be driven downwardly in the same manner for connection to another group of the upwardly projecting double ended nails. Successive blocks in row $R_3$ are attached together at their upper sides by connector straps 22 and nails 40 driven downwardly through those straps and into the tops of the blocks of row $R_3$. If there are to be additional rows above row $R_3$, as would normally be the case, the nails 40 may be double ended nails functioning to secure the blocks of rows $R_3$ and $R_4$ together in the same manner that nails 21 secure together the blocks of rows $R_2$ and $R_3$, and the blocks of rows $R_1$ and $R_2$. However, for simplicity of illustration, it is assumed in FIGS. 1 and 3 that row $R_3$ is to be the upper row of blocks, in which case the nails 40 driven into the upper sides of the blocks of row $R_3$ are conventional single ended nails corresponding to the nails 38 of FIG. 3.

Figure 4:
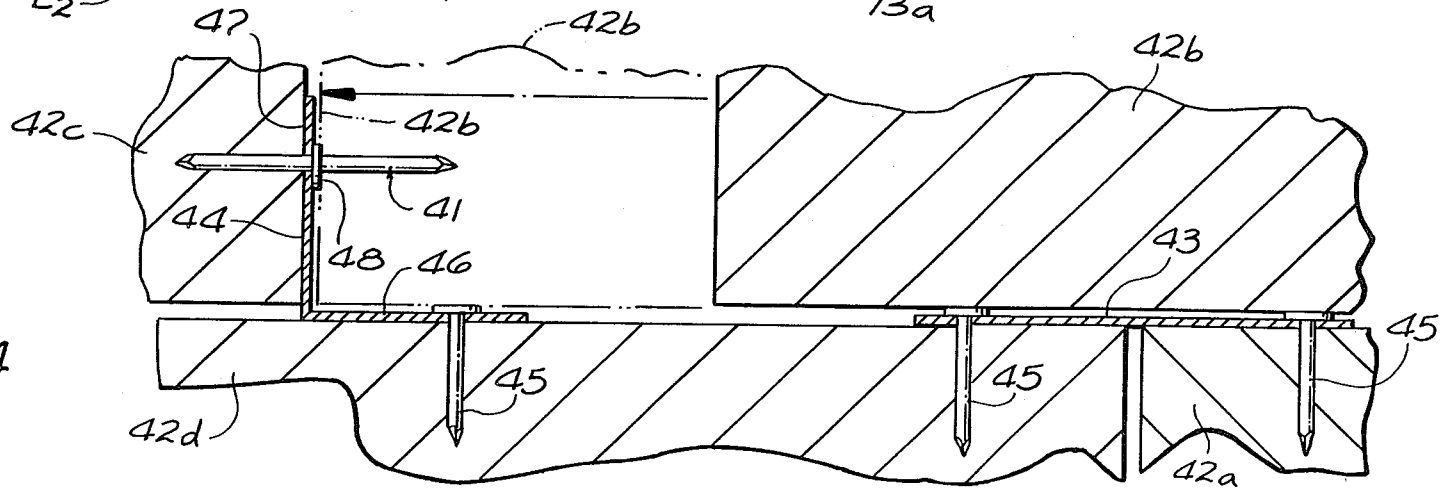
FIG. 4 is a view similar to FIG. 3, but showing a variational arrangement.

FIG. 4 shows a variational arrangement which may be considered as identical with that of FIGS. 1 to 3 except that double ended nails 41 corresponding to nails 21 of the first form of the invention extend horizontally rather than vertically and are driven horizontally into adjacent blocks of a particular row. The connector straps 43 and angle brackets 44 of FIG. 4 may be identical with the straps 22 and brackets 23 respectively of FIG. 3, and may be located in the same positions relative to the connected blocks as in FIGS. 1 to 3, but with straps 43 being secured to the underlying blocks by single ended nails 45, and with the horizontal arms 46 of brackets 44 also being secured to the underlying blocks by single ended nails 45.

After the three blocks 42*a* , 42*c* and 42*d* of FIG. 4, corresponding to blocks 13*a*, 13*c* and 13*d* respectively of FIGS. 1 to 3, have been moved into position, with two spaced straps 43 securing together blocks 42*a* and 42*d*, two of the angle brackets 44 are then moved against blocks 42*c* and 42*d*, and are nailed to block 42*d* by nails 45. The vertical arms 47 of brackets 44 are then secured to the adjacent block 42*c* by two of the double ended fasteners 41, whose left ends as viewed in FIG. 4 are driven leftwardly through openings in arms 47 and into block 42*c* with the heads 48 of the double ended nails tightly clamping brackets 44 against block 42*c*. The next block 42*b* is located in the full line position of FIG. 4, and driven leftwardly to the broken line position by hammer blows or other force, causing the rightwardly projecting ends of the two double ended nails 41 to penetrate the left end of block 42 and form a rigid connection thereto. Two more brackets 44 are then moved into position at the right end of the block 42*b* , and are secured to block 42*a* by single ended nails and to block 42*b* by double ended nails, against which a next successive block can be moved leftwardly it in place. This process is repeated for each block in that row successively, with each block being secured in position by being driven horizontally relative to and against a pair of the horizontally projecting double ended nails.

FIGS. 5 and 6 show a variational type of double ended fastener 49 which may be employed in the arrangement of FIGS. 1 to 3 or the arrangement of FIG. 4, in lieu of the fasteners 21 and 41. The fastner 49 of FIG. 5 has a lower end 50 which is pointed and has an external thread 51 similar to a wood screw, enabling that lower end to be screwed into a block 52 rather than being driven as a nail. The upper end 53 of fastener 49 of FIGS. 5 and 6 is unthreaded and formed as a nail having a cylindrical shank pointed at its upper extremity 5, with the two ends 50 and 53 of the fastener 49 being centered about and extending along a common vertical axis 55. At the upper end of the screw portion 50 of fastener 49, there is provided an enlarged head 56 which may be tapered to fit into a countersunk hole in block 52 and in a connector strap 57 corresponding to and serving the function of one of the straps 22 of the first form of the invention.

It is contemplated that the oppositely directed screw end 50 and nail end 53 of fastener 49 may be formed integrally of a single piece of material, or may be formed separately and be detachable from one another. FIGS. 5 and 6 show such a detachable arrangement, in which the head 56 of screw 50 is provided with an internal thread 58 engageable with an external thread 59 formed at the lower end of the nail end 53 to secure the parts together. The head of the screw may have two diametrically opposed recesses 60 projecting outwardly beyond the diameter of thread 58 to form together the equivalent of a screw driver slot for receiving a screw driver or other tool in screwing the lower end 50 of the fastener into block 52 while detached from the upper end 53 of the fastener. After the lower end 50 of fastener 49 of FIGS. 5 and 6 has been separately screwed into position to the location represented in FIG. 6, the upper end 53 of the fastener is secured rigidly to the lower end by threaded connection 58–59, so that the nail end 53 then projects upwardly in the same manner discussed in connection with the upper ends 29 of the double ended nails 21 of FIG. 3, to enable a block to be secured thereto by driving the block downwardly against the upwardly projecting nail end. Similarly, the fastener of FIGS. 5 and 6 may be employed in the FIG. 4 arrangement, in lieu of the double ended fastener 41, with the threaded end of the fastener of FIGS. 5 and 6 being screwed leftwardly into block 42*c* of FIG. 4, and with the unthreaded end then being attached to the threaded end and projecting rightwardly for penetration into block 42*b* as that block is moved leftwardly. To assist in connecting the unthreaded end 53 of fastener 49 to threaded end 50, the unthreaded end may have a portion 150 of non-circular (typically square) cross section transversely of axis 55, to be engaged by a wrench or other tool for turning end 53 to screw it into thread 58.

FIGS. 7 and 8 show another arrangement which is similar to that of FIGS. 5 and 6, and which includes a fastener 61 having a lower pointed threaded end 62 adapted to be screwed into one block and an upwardly projecting portion 63 extending along the same axis 64 as the lower threaded end 62 and typically taking the form of a short blade having a tapered essentially sharp upper edge 65. An enlarged head 66 is provided on the fastener 61 intermediate its lower threaded and upper unthreaded ends. In utilizing the device of FIGS. 7 and 8, the lower threaded end can be screwed into a block by an appropriate tool, such as a tool engaging the upwardly projecting flat blade 63, after which an upper block can be moved downwardly against the portion 63 in a manner driving that portion into the material of the upper block and forming a connection thereto as in the FIGS. 1 to 3 form of the invention. The device of FIGS. 7 and 8 may of course also be employed in the arrangement of FIG. 4, with the threaded and unthreaded ends extending horizontally rather than vertically.

While certain specific embodiments of the present invention have been disclosed as typical, the invention is of course not limited to these particular forms, but rather is applicable broadly to all such variations as fall within the scope of the appended claims.

I claim:

1. The method that comprises:

arranging a series of blocks to form a wall having a series of vertically successive rows of said blocks;

attaching a first arm of an angle bracket to the upper side of a first block in a first row of said blocks;

driving a first end of a doubled ended fastener generally horizontally through an opening in a second arm of said angle bracket and then into a face of a second block in a second row of blocks above said first row and to a position in which a head of said fastener between said first end and a second oppositely projecting end thereof attaches said second arm to said second block; and thereafter forcing a third block in said second row generally horizontally toward said second block and toward said second arm of the bracket to cause said second end of the fastener to penetrate horizontally into a face of said third block.

2. A wall formed by the method of claim 1.

3. The method as recited in claim 1, in which said first arm of said angle bracket is attached to said first block by driving a headed fastener downwardly through said first arm and into said first block.

4. The method as recited in claim 1, including attaching said first block to a horizontally adjacent fourth block in said first row of blocks by driving fasteners downwardly through different portions of an essentially horizontally connector strap and into said first and fourth blocks.

5. The method as recited in claim 1, including attaching said first block to a horizontally adjacent fourth block in said first row of blocks by driving fasteners downwardly through different portions of an essentially horizontal connector strap and into said first and fourth blocks, said first arm of said angle bracket being attached to said first block by driving a headed fastener downwardly through said first arm and into said first block.

6. A wall formed by the method of claim 3.

7. A wall formed by the method of claim 4.

8. A wall formed by the method of claim 5.

* * * * *